US006622675B1

(12) United States Patent
Simpson

(10) Patent No.: US 6,622,675 B1
(45) Date of Patent: Sep. 23, 2003

(54) DUAL PWM CONTROL OF A CENTER MOUNTED SPOOL VALUE TO CONTROL A CAM PHASER

(75) Inventor: Roger Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/281,571

(22) Filed: Oct. 28, 2002

Related U.S. Application Data

(60) Provisional application No. 60/374,597, filed on Apr. 22, 2002.

(51) Int. Cl.[7] ..... F01L 1/34

(52) U.S. Cl. ..... 123/90.15; 123/90.17; 123/90.31

(58) Field of Search ..... 123/90.11–90.18, 123/90.31, 90.6

(56) References Cited

U.S. PATENT DOCUMENTS

| | | | | |
|---|---|---|---|---|
| 4,627,825 A | | 12/1986 | Bruss et al. | 464/2 |
| 5,107,804 A | | 4/1992 | Becker et al. | 123/90.17 |
| 5,150,671 A | | 9/1992 | Suga | 123/90.17 |
| 5,218,935 A | | 6/1993 | Quinn, Jr. et al. | 123/90.17 |
| 5,333,577 A | | 8/1994 | Shinojima | 123/90.15 |
| 5,363,817 A | | 11/1994 | Ikeda et al. | 123/90.15 |
| 5,497,738 A | | 3/1996 | Siemon et al. | 123/90.17 |
| 5,666,914 A | | 9/1997 | Ushida et al. | 123/90.17 |
| 5,937,806 A | * | 8/1999 | Lyko et al. | 123/90.15 |

* cited by examiner

*Primary Examiner*—Thomas Denion
*Assistant Examiner*—Kyle Riddle
(74) *Attorney, Agent, or Firm*—Brown & Michaels, PC; Greg Dziegielewski

(57) ABSTRACT

A remotely mounted 4-way valve (2) or two solenoid valves (12) (13) control a center mounted spool valve (28). In the 4-way valve embodiment, one control port (3) provides oil pressure to one end (26) of the spool valve (28) and the other control port (4) provides oil pressure to the other end (27) of the spool (25). In the embodiment with two solenoid valves, one solenoid valve control port (16) feeds oil to one end (26) of the spool (25) and another solenoid valve control port (17) feeds oil to the other end (27). For both of these control systems, the relationship of percent of control signal to percent of control pressure is mapped into the controller, and varies as the engine oil pressure and temperature changes. In a preferred embodiment, a position sensor (34) mounted to the spool valve position reduces this error by having a control loop controlling the position of the spool valve. There is also another loop to control the phaser angle.

30 Claims, 8 Drawing Sheets

DUAL PWM CONTROL OF A CENTER MOUNTED SPOOL VALUE TO CONTROL A CAM PHASER

REFERENCE TO RELATED APPLICATIONS

This application claims an invention which was disclosed in Provisional Application No. 60/374,597, filed Apr. 22, 2002, entitled "DUAL PWM CONTROL OF A CENTER MOUNTED SPOOL VALVE TO CONTROL A CAM PHASER". The benefit under 35 USC §119(e) of the United States provisional application is hereby claimed, and the aforementioned application is hereby incorporated herein by reference.

BACKGROUND OF THE INVENTION

1. Field of the Invention

This invention relates to a hydraulic control system for controlling the operation of a variable camshaft timing (VCT) system. More specifically, the present invention relates to a control system which utilizes a dual pulsed width modulated solenoid or a four-way valve to control a cam phaser.

2. Description of Related Art

U.S. Pat. No. 4,627,825 uses two electromagnetic solenoids, each operating a valve to move a phaser in one direction or the other. The pressure moves the phaser directly.

U.S. Pat. No. 5,150,671 uses an electromagnetically operated external spool valve to to supply switched hydraulic pressure to activate a central spool valve. The external valve is a two-way PWM valve.

U.S. Pat. No. 5,333,577 teaches closed loop control of a spool valve using an electromagnetic linear solenoid. This patent describes a strategy for computing solenoid position based on deviation from desired angle and temperature.

U.S. Pat. No. 5,363,817 teaches a control strategy to avoid operational variations.

U.S. Pat. No. 5,666,914 shows a vane phaser which has pilot valves in the rotor.

Consideration of information disclosed by the following U.S. Patents, which are all hereby incorporated by reference, is useful when exploring the background of the present invention.

There are many ways to control the position of a spool valve that controls the oil flow to and from the chamber of a vane or piston style cam phaser. These control methods include an external mounted solenoid DPCS (differential pressure control system), shown in U.S. Pat. No. 5,107,804, a variable force solenoid, shown in U.S. Pat. No. 5,497,738, and a stepper motor, shown in U.S. Pat. No. 5,218,935.

Although the variable force solenoid reduces the dependency of the control system on the oil pressure from the engine and eliminates the need to have a spool with different diameters, it does need to be mounted in front of the cam phaser and causes the length of the engine to increase. The VFS pushes on one end of the center mounted spool valve against a spring that will return the valve to a default and fail-safe position when the solenoid is off.

The stepper motor system also increases the length of the engine as it is mounted in front of the cam phaser. This system has trouble with the fail-safe positional control of the phaser. The position of the stepper motor will not return to a fail-safe position once it is turned off.

SUMMARY OF THE INVENTION

The present invention includes a remotely mounted 4-way valve or two solenoid valves to control a center mounted spool valve. In the 4-way valve embodiment, one control port provides oil pressure to one end of the spool valve and the other control port provides oil pressure to the other end of the spool. In the embodiment with two solenoid valves, one solenoid valve control port feeds oil to one end of the spool and another solenoid valve control port feeds oil to the other end. With these systems, the two control pressures are always a percentage of the engine oil pressure. For both of these control systems, the relationship of percent of control signal to percent of control pressure is mapped into the controller, and can vary as the engine oil pressure and temperature changes. One method to reduce this error is to have a position sensor mounted to the spool valve position and have a control loop controlling the position of the spool valve. There is also another loop to control the phaser angle.

DETAILED DESCRIPTION OF THE INVENTION

The present invention comprises either a remotely mounted 4-way valve that is fed by oil pressure from the engine or two solenoid valves. In the 4-way valve embodiment, one control port provides oil pressure to one end of the spool valve and the other control port provides oil pressure to the end of the spool. This allows both ends of the spool to be the same diameter and decreases the dimensional tolerance of the center mounted spool valve. The oil can be fed through the center of the cam from one of the cam bearings. The 4-way valve has a default position that is at one end of its travel so that one of the control ports can be the port that supplies oil to the phaser to return it to its default position or fail-safe position if the solenoid fails.

A second embodiment of the present invention uses two separate solenoid valves. One of the solenoid valve control ports feeds oil to one end of the spool and another solenoid valve control port feeds oil to the other end. By adjusting the pressure from these solenoids, the spool can be moved back and forth to control the oil to the phaser and control the position of the phaser. For the fail-safe condition, one solenoid is normally open and the other is normally closed. If the solenoids fail, one solenoid will supply full engine pressure to the end of the spool that will cause the phaser to move to the default position. Because these solenoids rely on oil pressure to move the center mounted spool valve in the phaser, they can be mounted under the cam cover or remotely and not extend the length of the engine. The oil passageways preferably go through the center of the camshaft.

With this system, the two control pressures are always a percentage of the engine oil pressure. For the control system the relationship of percent of control signal to percent of control pressure is mapped into the controller. This relationship varies as the engine oil pressure and temperature changes. In this case, the control law integrator compensates for any phaser set point error. The present invention reduces this error by having a position sensor mounted to the spool valve position. A control loop controls the position of the spool valve. This type of system reduces any frictional or magnetic hysteresis in the spool and solenoid control system. There is also another loop to control the phaser angle. The inner loop controls the spool valve position, and the outer loop controls the phase angle. Added to the spool valve position is an offset to move the spool valve to its steady state or null position. This null position is required so that the spool can move in to move the phaser in one direction and outward to move the phaser in the other direction.

Figure 1:
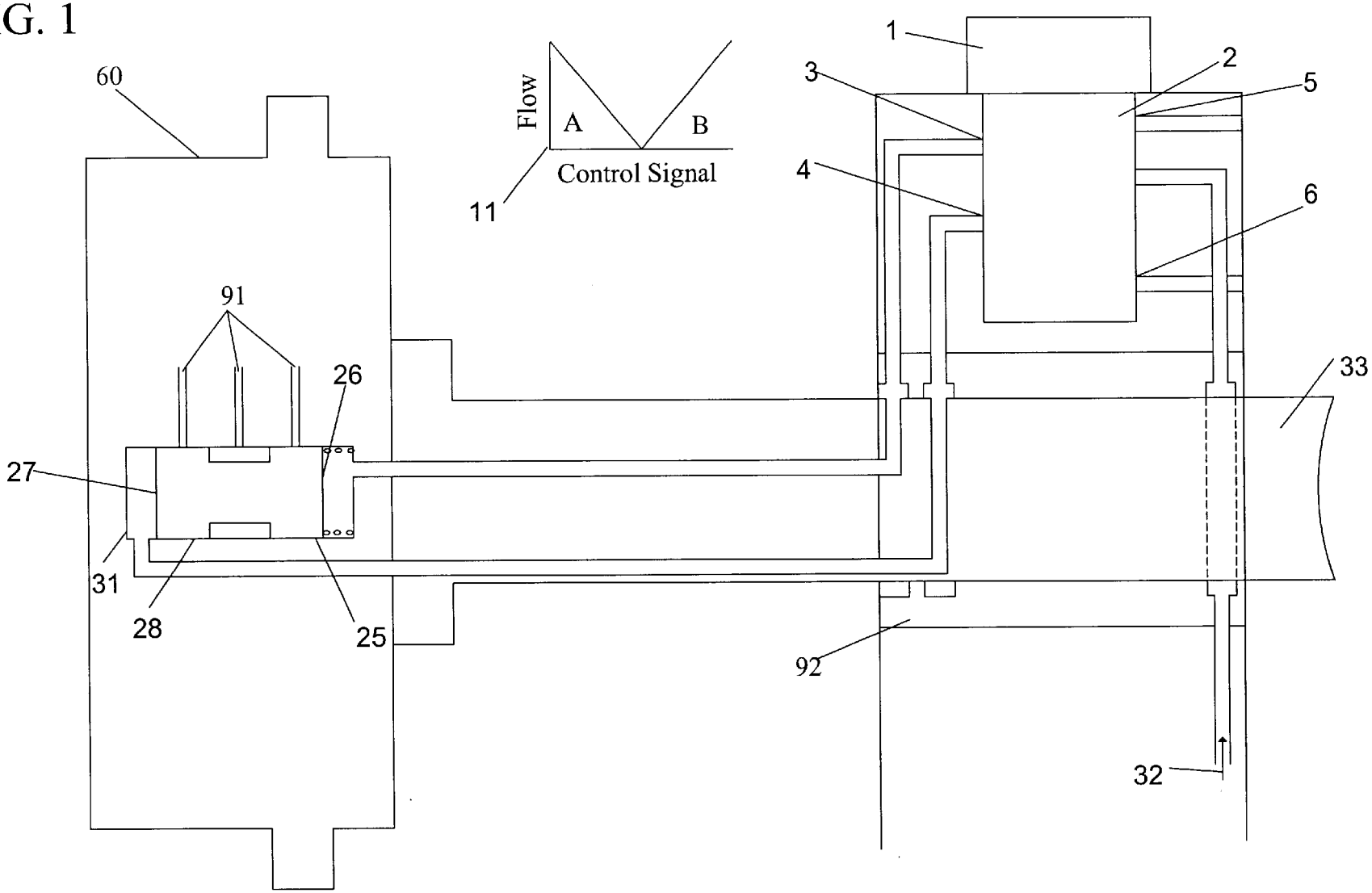
FIG. 1 shows four-way valve control of a center mounted spool valve in an embodiment of the present invention.
Figure 5:
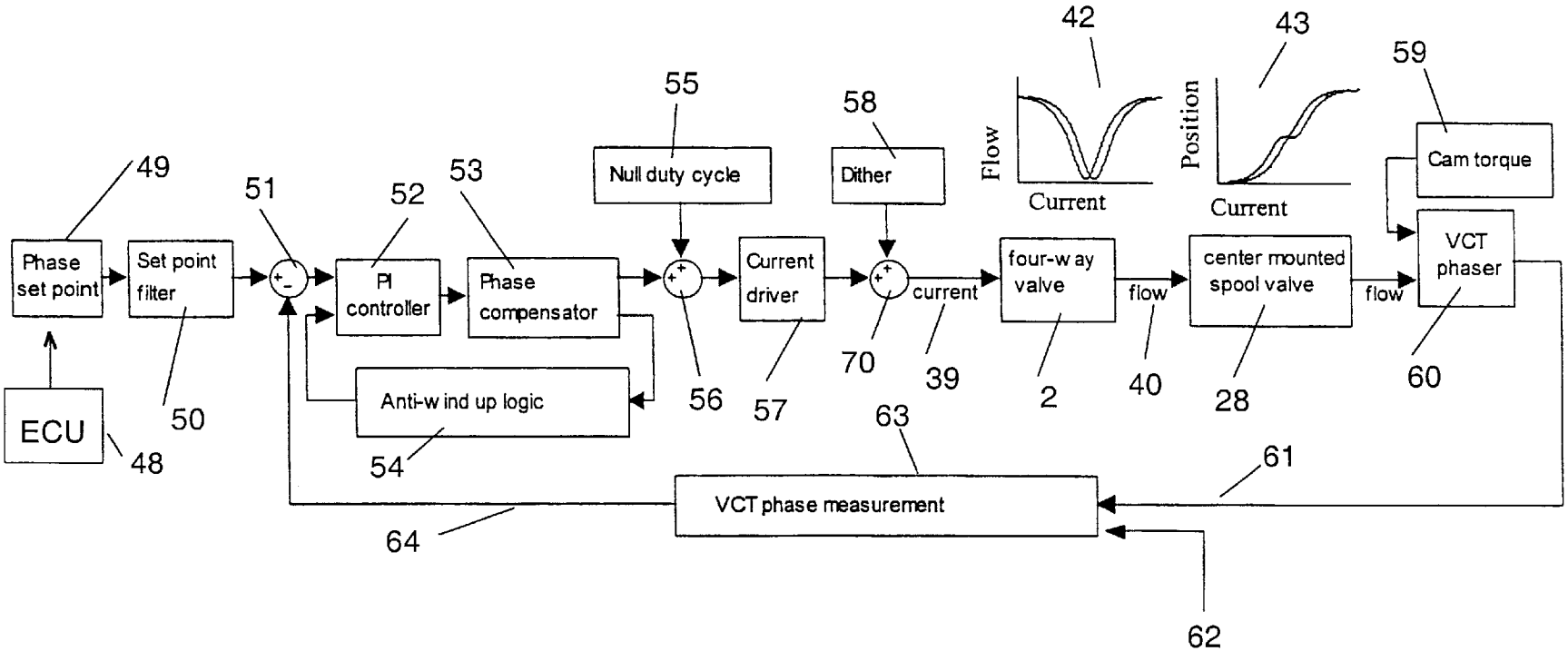
FIG. 5 shows a block diagram of four-way valve control without position feedback.

Referring now to FIGS. 1 and 5, spool valve (28) is made up of a bore (31) and vented spool (25) which is slidable to and fro within the bore (31). Passageways (91) to the advance and retard chamber (not shown) are shown for exemplary purposes only, and depend upon the type of phaser being used. The position of vented spool (25) within bore (31) is influenced by a remotely-mounted four-way valve (2) that is fed by oil pressure (32) from the engine. The 4-way valve (2) acts on the ends of the spool (25). Pulses go to the coil (1), which actuates the valve (2). The coil (1) is preferably part of a solenoid, which actuates the 4-way valve (2). The 4-way valve (2) is preferably controlled by an electrical current applied to coil (1) in response to a control signal. The control signal preferably comes directly from an electronic engine control unit (ECU) (48).

One pressure port (3) is coupled to one end (26) of the spool (25) and the other presure port (4) is coupled to the other end (27) of the spool (25). This allows both ends (26) and (27) of the spool (25) to be the same diameter and decreases the dimensional tolerance of the center mounted spool valve (28). Two exhaust ports (5) and (6) exhaust oil from the device. Although two exhaust ports are shown in the figures, only one is required. The oil supply (32) is preferably fed through the center of a camshaft (33) from one of the cam bearings (92).

The camshaft (33) may be considered to be the only camshaft of a single camshaft engine, either of the overhead camshaft type or the in block camshaft type. Alternatively, the camshaft (33) may be considered to be either the intake valve operating camshaft or the exhaust valve operating camshaft of a dual camshaft engine.

The 4-way valve (2) preferably has a default position that is at one end of its travel so that one of the pressure ports is the port that supplies oil to the phaser (60) to return it to its default position or fail-safe position if the solenoid fails. Phaser (60) is shown without detail in the figures. Graph (11) shows that the flow from pressure port (3) to spool end (26) decreases as the control signal increases. Once the flow from pressure port (3) to the spool is negligible, the flow from pressure port (4) to spool end (27) begins to increase. This control of the flow in response to the control signal allows the remotely mounted 4-way valve to control the movement of the spool (25).

FIG. 5 shows a block diagram of a control system of an embodiment of the present invention. The Engine Control Unit (ECU) (48) decides on a phase set point (49), based on various demands on the engine and system parameters (temperature, throttle position, oil pressure, engine speed, etc.). The set point is filtered (50) and combined (51) with a VCT phase measurement (64) in a control loop with a PI controller (52), phase compensator (53), and anti-windup logic (54). The output of this loop is combined (56) with a null duty cycle signal (55) into a current driver (57), whose output is combined (70) with a dither signal (58) to provide current (39) to drive the 4-way valve (2).

The 4-way valve (2) controls the movement of oil to the ends of the spool (25) to move the spool (25), which is located in the center of the phaser (60). The spool valve (28), in turn, controls fluid (engine oil) to activate the VCT phaser (60), either by applying oil pressure to the vane chambers or by switching passages to allow cam torque pulses (59) to move the phaser (60). The cam position is sensed by a cam sensor (61), and the crank position (or the position of the phaser drive sprocket, which is connected to the crankshaft) is also sensed by sensor (62), and the difference between the two is used by a VCT phase measurement circuit (63) to derive a VCT phase signal (64), which is fed back to complete the loop. Similar to graph (11), graph (42) shows the flow in response to a change in current.

In the system of FIGS. 1 and 5, the two control pressures are always a percentage of the engine oil pressure. For the control system the relationship of percent of control signal to percent of control pressure is mapped into the controller. This relationship varies as the engine oil pressure and temperature changes. In this case, the control law integrator compensates for any phaser set point error.

Figure 2:
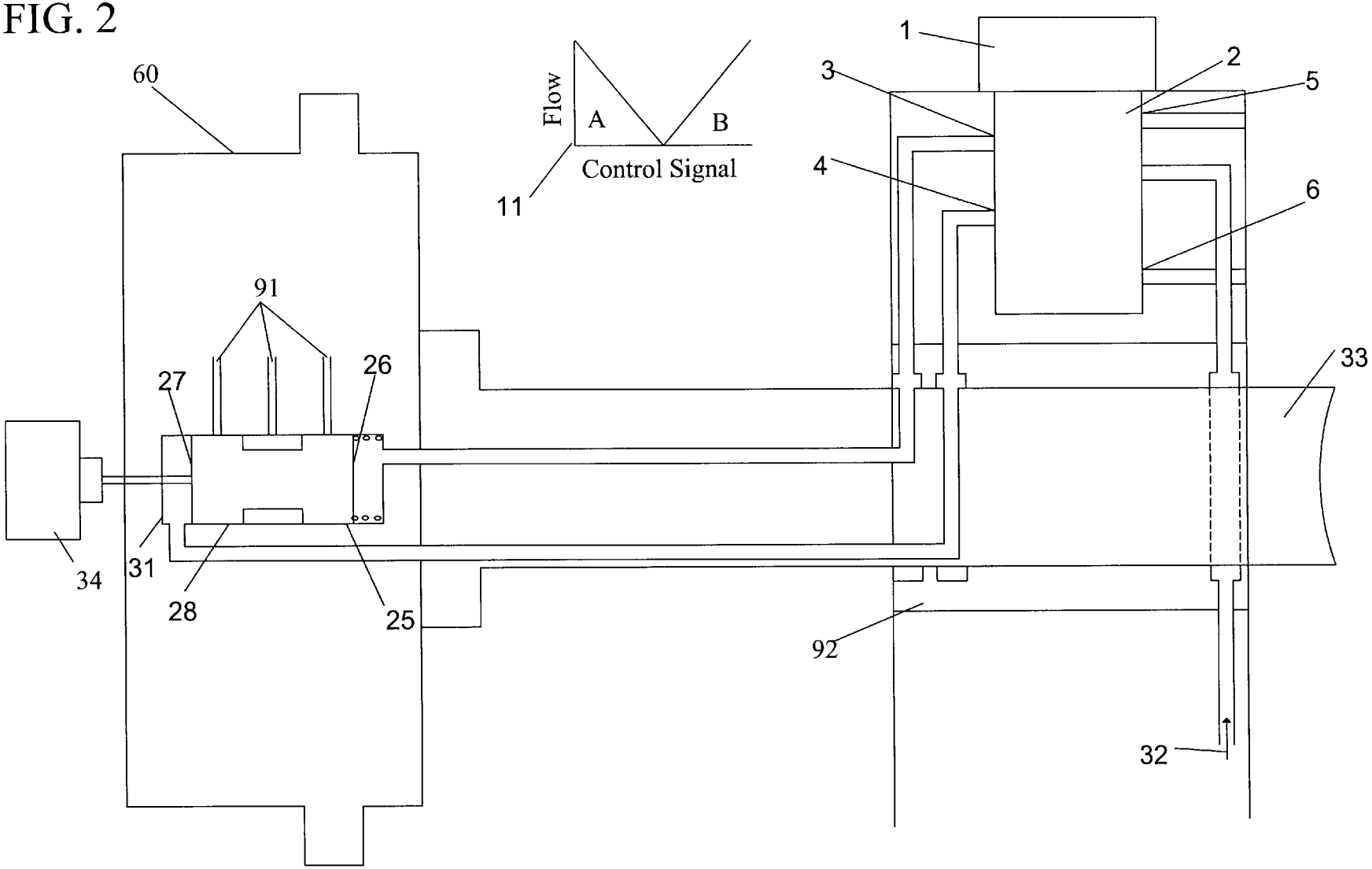
FIG. 2 shows four-way valve control of a center mounted spool valve with a position sensor in an embodiment of the present invention.
Figure 6:
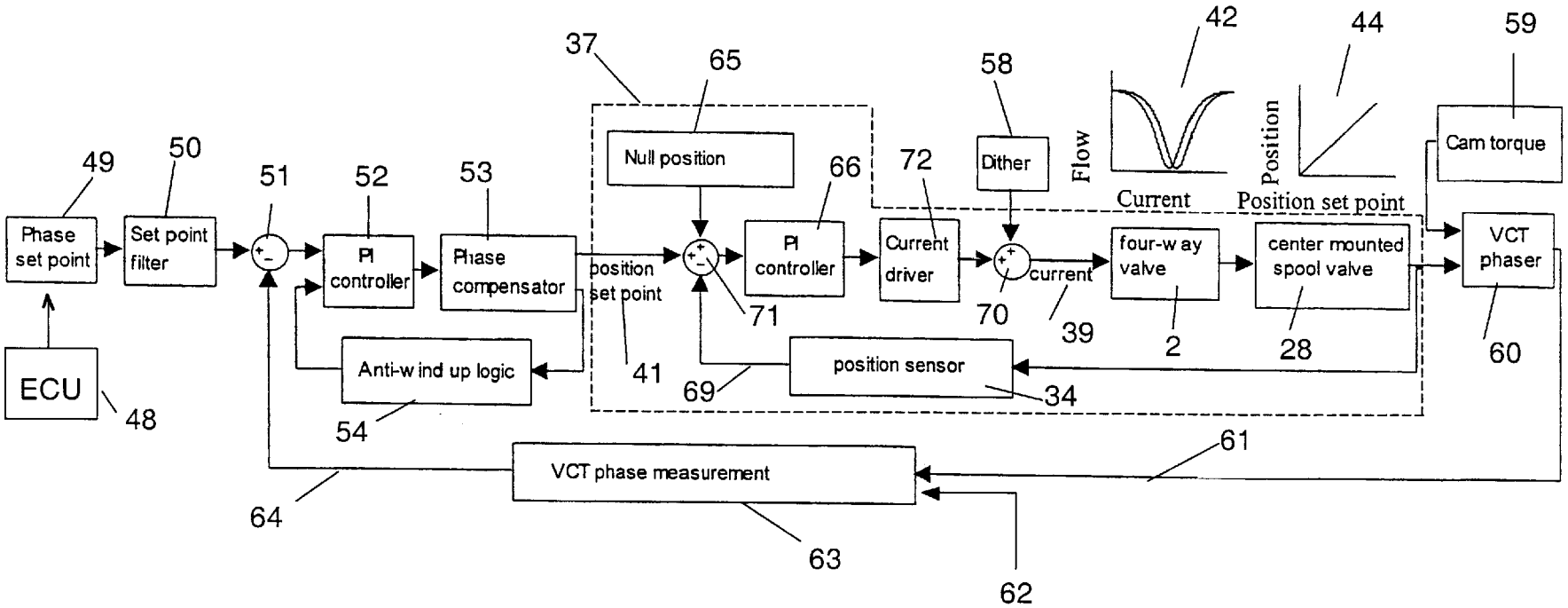
FIG. 6 shows a block diagram of four-way valve control with position feedback.

Referring now to FIGS. 2 and 6, the present invention reduces this error by having a position sensor (34) mounted to the spool valve position. The position sensor (34) is mounted so as to sense the position of the spool (25). Although the position sensor (34) physically contacts the spool (25) in the figures, physical contact is not necessary. For example, the position sensor (34) could be optically, capacitively or magnetically coupled to the spool (25). Position sensors (34) which could be utilized in this invention include, but are not limited to, linear potentiometers, hall effect sensors, and tape end sensors.

FIG. 6 shows a block diagram of a control circuit of this embodiment of the invention, which uses a feedback loop to control the position of the spool valve, and thereby reduce any frictional or magnetic hysteresis in the spool and solenoid control system. A second feedback loop controls the phaser angle. The inner loop (37) controls the spool valve position and the outer loop (similar to that shown in FIG. 5) controls the phase angle. An offset is preferably added to the spool valve position to move the spool valve to its steady state or null position. This null position is required so that the spool can move in to move the phaser in one direction and outward to move the phaser in the other direction.

The basic phaser control loop of FIG. 6 is the same as in FIG. 5, and where the figures are the same, the circuit will not be discussed separately. The difference between the embodiment of the invention shown in FIG. 6 and the embodiment in FIG. 5 lies in the inner control loop (37), which starts with the output of phase compensator (53). The output of the compensator (53) is combined (71) with a null position offset (65) and the output (69) of the spool position sensor (34), and input to the PI controller (66) for the inner loop (37). The output of the PI controller (66) is input to a current driver (72), whose output is combined (70) with a dither signal (58), and the resulting current drives the 4-way valve (2). The position of the center mounted spool valve (28) is read by the position sensor (34), and the output (69) of the position sensor (34) is fed back to complete the loop (37).

In contrast with graph (43) in FIG. 5, where the position varies as current increases, when the position sensor control loop (37) is added, position is linearly related to the position set point (41), as shown in graph (44).

Figure 3:
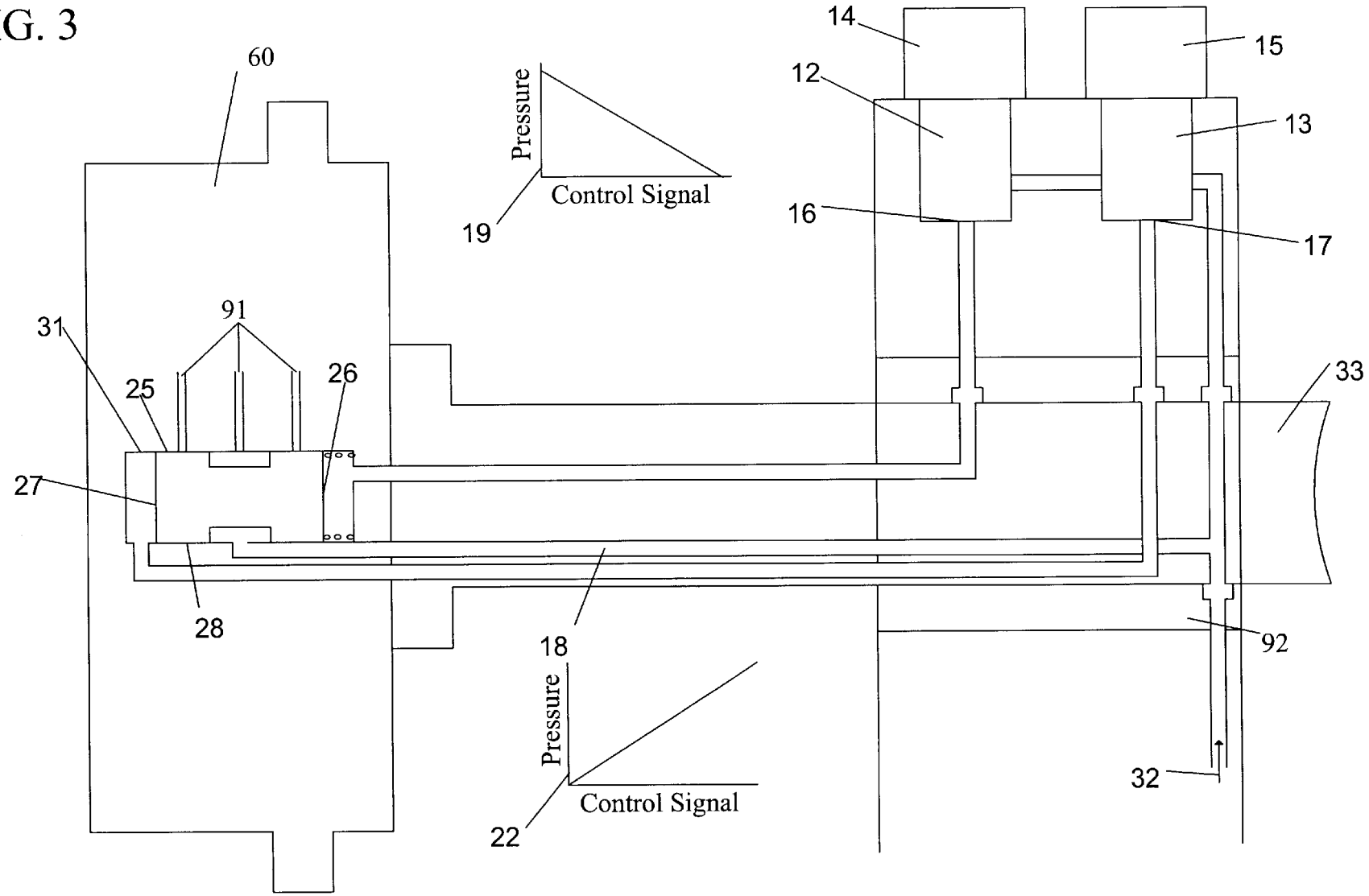
FIG. 3 shows dual PWM or dual proportional control of a center mounted spool valve in an embodiment of the present invention.
Figure 7:
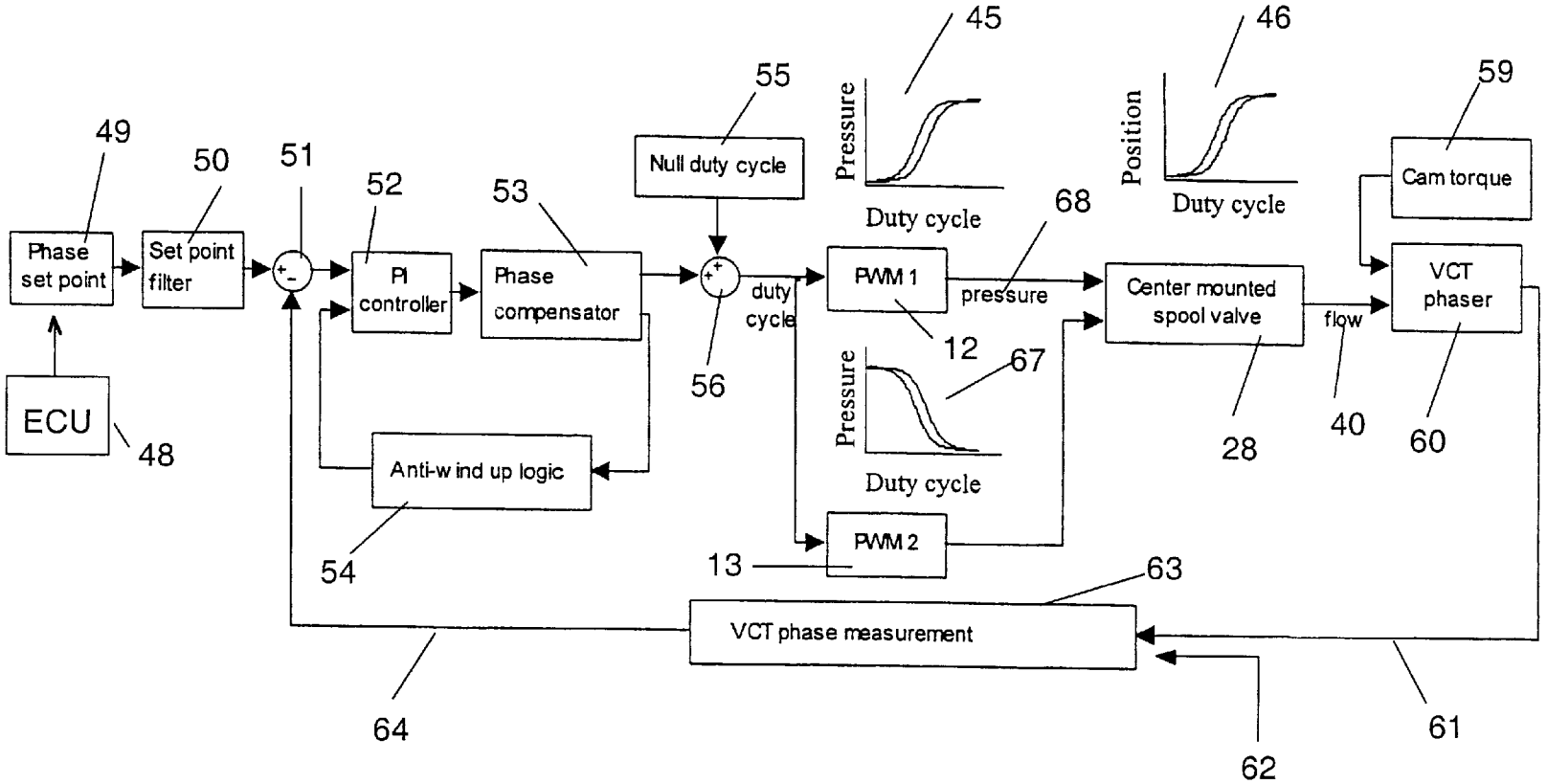
FIG. 7 shows a block diagram of dual PWM control without position feedback.

Referring now to FIGS. 3 and 7, another embodiment of the present invention uses two separate solenoid valves (12) and (13). The solenoid valves are preferably pulsed width modulated solenoids (PWM). Pulses from coils (14) and (15) actuate valves (12) and (13), respectively. One of the solenoid valve (12) pressure ports (16) feeds oil to one end (26) of the spool (25) and another solenoid valve pressure port (17) feeds oil to the other end (27). By adjusting the pressure from these solenoids, the spool (25) can be moved back and forth to control the oil to the phaser (60) and control the position of the phaser (60). A control pressure supply (18) is also ported to the phaser.

For the fail-safe condition, one solenoid (12) is made to be normally open (see graph 19) and the other solenoid (13) is made to be normally closed (see graph 22). If the solenoids fail, one solenoid supplies full engine pressure to the end of the spool that causes the phaser to move to the default position. Because these solenoids rely on oil pressure (32) to move the center mounted spool valve (28) in the phaser, they are preferably mounted under the cam cover or remotely and do not extend the length of the engine. The oil passageways preferably go through the center of the camshaft (33).

FIG. 7 shows a block diagram of a control system of this embodiment of the present invention. The Engine Control Unit (ECU) (48) decides on a phase set point (49), based on various demands on the engine and system parameters (temperature, throttle position, oil pressure, engine speed, etc.). The set point is filtered (50) and combined (51) with a VCT phase measurement (64) in a control loop with a PI controller (52), phase compensator (53), and anti-windup logic (54).

The output of this loop is combined (56) with a null duty cycle signal (55) into first (12) and second (13) solenoids. The pressure ports (16) and (17) from the two solenoids (12) and (13), respectively, port oil to the ends of the spool (25) to control movement of the spool (25), which is located in the center of the phaser (60). As graphs (45) and (67) show, for solenoid (12), an increase in duty cycle increases the pressure while, conversely, for solenoid (13), an increase in duty cycle decreases the pressure.

The spool valve (28), in turn, controls the flow (40) of fluid (engine oil) to activate the VCT phaser (60), either by applying oil pressure to the vane chambers or by switching passages to allow cam torque pulses (59) to move the phaser (60). The cam position is sensed by a cam sensor (61), and the crank position (or the position of the phaser drive sprocket, which is connected to the crankshaft) is also sensed by sensor (62), and the difference between the two is used by a VCT phase measurement circuit (63) to derive a VCT phase signal (64), which is fed back to complete the loop.

In the system of FIGS. 3 and 7, the two control pressures are always a percentage of the engine oil pressure. For the control system the relationship of percent of control signal to percent of control pressure is mapped into the controller. This relationship varies as the engine oil pressure and temperature changes. In this case, the control law integrator compensates for any phaser set point error.

Figure 4:
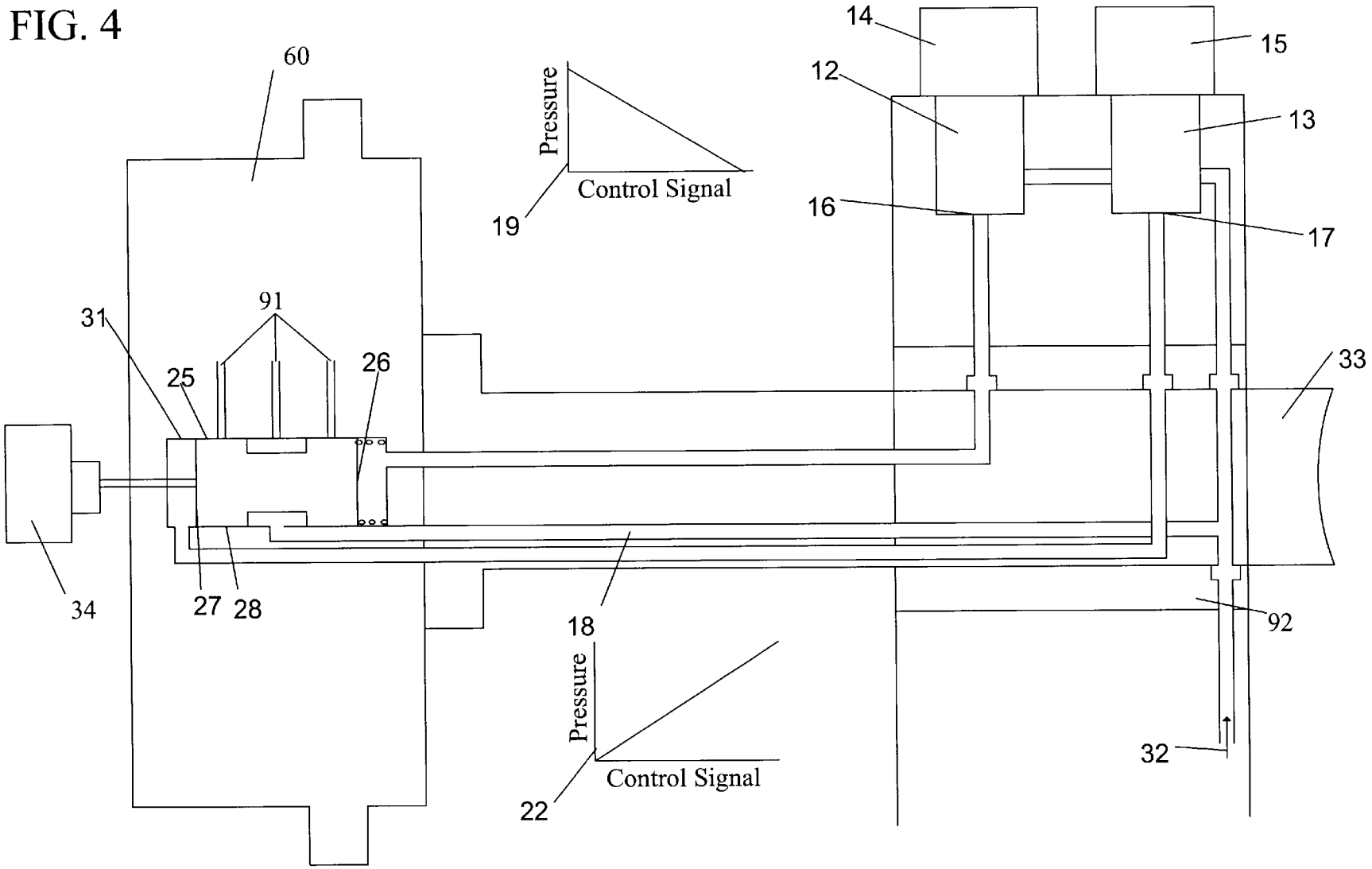
FIG. 4 shows dual PWM or dual proportional control of a center mounted spool valve with a position sensor in an embodiment of the present invention.
Figure 8:
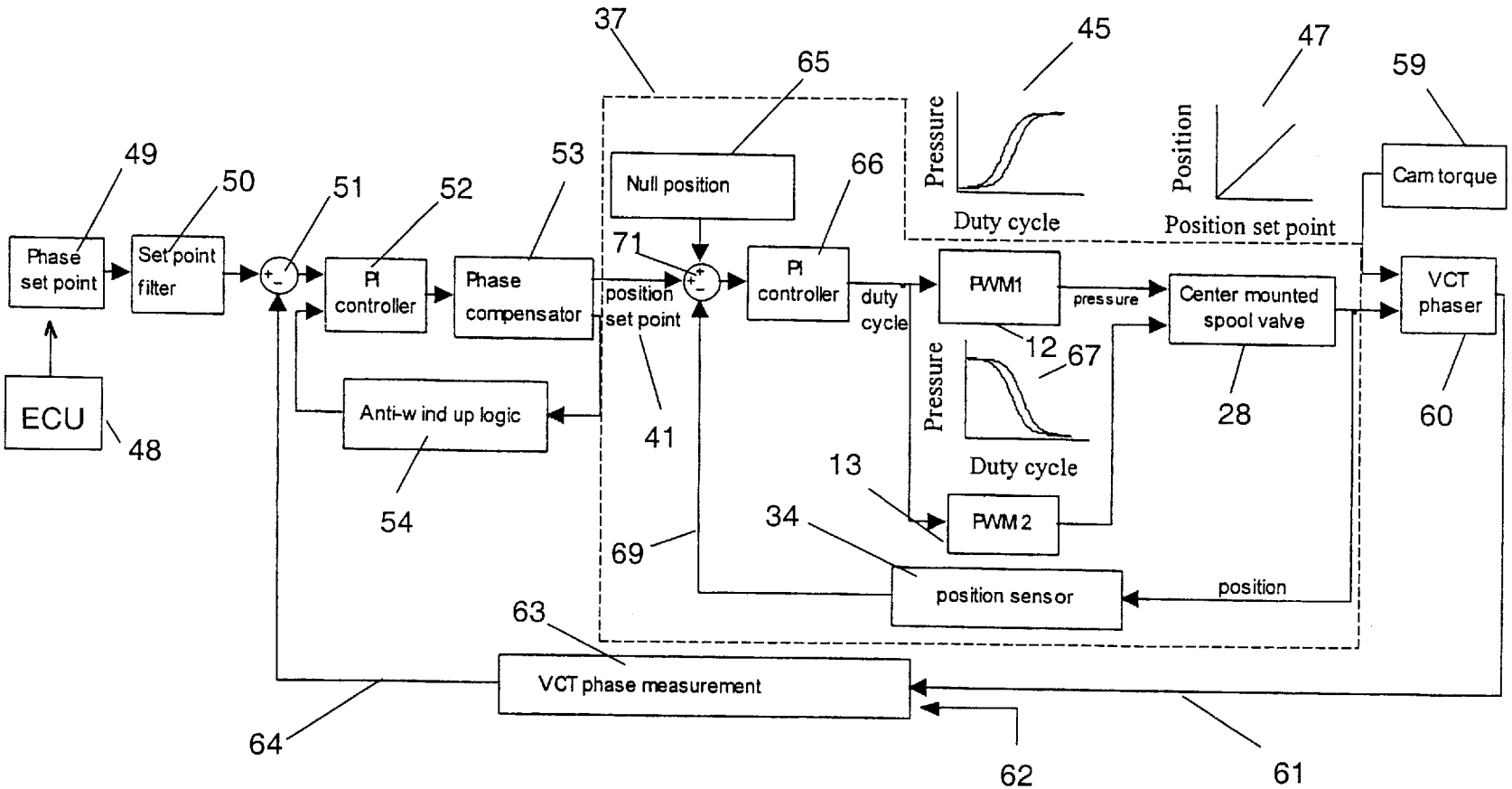
FIG. 8 shows a block diagram of dual PWM control with position feedback.

Referring now to FIGS. 4 and 8, the present invention reduces this error by having a position sensor (34) mounted to the spool valve position. The position sensor (34) is mounted so as to sense the position of the spool (25). Although the position sensor (34) physically contacts the spool (25) in the figures, physical contact is not necessary. For example, the position sensor (34) could be optically, capacitively or magnetically coupled to the spool (25). Position sensors (34) which could be utilized in this invention include, but are not limited to, linear potentiometers, hall effect sensors, and tape end sensors.

FIG. 8 shows a block diagram of a control circuit of this embodiment of the invention, which uses a feedback loop to control the position of the spool valve, and thereby reduce any frictional or magnetic hysteresis in the spool and solenoid control system. A second feedback loop controls the phaser angle. The inner loop (37) controls the spool valve position and the outer loop (similar to that shown in FIG. 7) controls the phase angle. An offset is preferably added to the spool valve position to move the spool valve to its steady state or null position. This null position is required so that the spool can move in to move the phaser in one direction and outward to move the phaser in the other direction.

The basic phaser control loop of FIG. 8 is the same as in FIG. 7, and where the figures are the same, the circuit will not be discussed separately. The difference between the embodiment of the invention shown in FIG. 8 and the embodiment in FIG. 7 lies in the inner control loop (37), which starts with the output of phase compensator (53). The output of the compensator (53) is combined (71) with a null position offset (65) and the output (69) of the spool position sensor (34), and input to the PI controller (66) for the inner loop (37). The output of the PI controller (66) is input into the first (12) and second (13) solenoids. The resulting pressure controls the position of the center mounted spool valve (28). The position of the center mounted spool valve (28) is read by the position sensor (34), and the output (69) of the position sensor (34) is fed back to complete the loop (37).

In contrast with graph (46) in FIG. 7, where the position varies as current increases, when the position sensor control loop (37) is added, position is linearly related to the position set point (41), as shown in graph (47).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system for an internal combustion engine having a crankshaft, at least one camshaft, a cam drive connected to the crankshaft, and a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser, the variable cam timing system comprising:

a) a spool valve (28) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser; and b) a four-way valve (2) comprising:

i) an electrical input, which controls a flow of pressure to the spool;

ii) a fluid pressure input;

iii) a first control port (3) coupled to a first end (26) of the spool;

iv) a second control port (4), coupled to a second end (27) of the spool; and v) at least one exhaust port;

wherein when the four-way valve is in a first position, the pressure input is connected to the first control port, and the exhaust port is connected to the second control port such that oil pressure is transferred to the first end of the spool;

wherein when the four-way valve is in a second position, the pressure input is connected to the second control port, and the exhaust port is connected to the first control port such that oil pressure is transferred to the second end of the spool; and wherein a position of the four-way valve causes the spool to move axially in the bore.

2. The variable cam timing system of claim 1, further comprising:

i) VCT phase measurement sensors (61)(62) coupled to the crankshaft and the at least one camshaft controlled by the variable cam timing system; and ii) a VCT control circuit comprising:

a cam phase input coupled to the VCT phase measurement sensors;

a phase set point input for accepting a signal representing a desired relative phase of the camshaft and crankshaft;

a combiner (56) comprising a first input coupled to a null duty cycle signal (55), a second input coupled to an output of a phase comparator; and an output;

a current driver (57) having an input coupled to the output of the combiner, and an output;

a four-way valve drive input coupled to the combiner output;

a four-way valve drive output coupled to the electrical input of the four-way valve;

a signal processing circuit accepting signals from the phase set point input, cam phase input, and four-way drive input and outputting to the four-way drive output such that when a phase set point signal is applied at the phase set point input, the control circuit provides an electrical signal at the four-way valve output to modulate the control ports such that oil is ported through one of the control ports, which moves the spool to control the variable cam phaser to shift the phase of the camshaft as selected by the phase set point signal.

3. The variable cam timing system of claim 1, further comprising a position sensor (34) coupled to the spool, having a position signal output representing the physical position of the spool.

4. The variable timing system of claim 3, further comprising:

i) a VCT control circuit comprising:

a cam phase input coupled to the VCT phase measurement sensors;

a phase set point input for accepting a signal representing a desired relative phase of the camshaft and crankshaft;

a spool valve position input coupled to the position signal output; and a four-way valve drive output coupled to the electrical input of the four-way valve;

a signal processing circuit accepting signals from the phase set point input, cam phase input, and spool valve position input and outputting to the four-way valve drive output such that when a phase set point signal is applied at the phase set point input, the control circuit provides an electrical signal at the four-way valve output to modulate the control ports such that oil is ported through one of the control ports, which moves the spool to control the variable cam phaser to shift the phase of the camshaft as selected by the phase set point signal.

5. The variable cam timing system of claim 4, in which the signal processing circuit comprises:

an outer loop for controlling the phase angle, coupled to the set point input, cam phase input, and four-way valve drive output; and an inner loop for controlling the spool valve position, coupled to the spool valve position input and to the inner loop;

such that the four-way valve drive output as set by the outer loop is modified by the inner loop based on the spool valve position.

6. The variable cam timing system of claim 5, in which:

a) the outer loop comprises:

i) an anti-windup loop comprising:

A) a first PI controller (52) having a first input coupled to the set point input; a second input coupled to the cam phase input; a third input and an output;

B) a phase compensator (53) having an input coupled to the output of the first PI controller and a first output and a second output; and C) anti-windup logic (54) having an input coupled to the second output of the phase compensator and an output coupled to the third input of the PI controller;

ii) a combiner (71) having a first input coupled to a null position offset signal (65), a second input coupled to the output of the phase comparator, a third input, and an output;

iii) a second PI controller (66) having an input coupled to the output of the combiner and an output; and iv) a current driver (72) having an input coupled to the output of the second PI controller and an output coupled to the four-way valve drive output; and b) the inner loop comprises coupling the spool valve position input to the third input of the combiner.

7. The variable cam timing system of claim 6, further comprising a dither signal (58) coupled to the four-way valve drive output.

8. The variable cam timing system of claim 3, wherein the position sensor is selected from the group consisting of a linear potentiometer, a hall effect sensor, and a tape end sensor.

9. The variable cam timing system of claim 3, wherein the spool and the position sensor are coupled by a means selected from the group consisting of a physical coupling, an optical coupling, a magnetic coupling, and a capacitive coupling.

10. The variable cam timing system of claim 1, wherein the oil from the control ports is fed through a center of the camshaft.

11. The variable cam timing system of claim 1, wherein the exhaust port comprises two exhaust ports.

12. A variable cam timing system for an internal combustion engine having a crankshaft, at least one camshaft, a cam drive connected to the crankshaft, and a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser, the variable cam timing system comprising:

a) a spool valve (28) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser;

b) a first solenoid valve (12) comprising:
- i) an electrical input, which controls a flow of pressure to a first end (26) of the spool;
- ii) a fluid pressure input; and
- iii) a control port (16) coupled to a first end (26) of the spool, wherein when the solenoid valve is actuated, the control port feeds engine oil pressure (32) to the first end of the spool; and c) a second solenoid valve (13) comprising:
- i) an electrical input, which controls a flow of pressure to the second end (27) of the spool;
- ii) a fluid pressure input; and
- iii) a control port (17) coupled to a second end (27) of the spool, wherein when the second solenoid valve is actuated, the control port feeds engine oil pressure (32) to the second end of the spool.

13. The variable cam timing system of claim 12, further comprising:

i) VCT phase measurement sensors (61)(62) coupled to the crankshaft and the at least one camshaft controlled by the variable cam timing system; and ii) a VCT control circuit comprising:
- a cam phase input coupled to the VCT phase measurement sensors;
- a phase set point input for accepting a signal representing a desired relative phase of the camshaft and crankshaft;
- a combiner (56) comprising a first input coupled to a null duty cycle signal (55), a second input coupled to an output of a phase comparator, and an output;
- a current driver (57) having an input coupled to the output of the combiner, and an output;
- a first solenoid drive input coupled to the combiner output;
- a second solenoid drive input coupled to the combiner output;
- a first solenoid drive output coupled to the electrical input of the first solenoid valve;
- a second solenoid drive output coupled to the electrical input of the second solenoid valve;
- a signal processing circuit accepting signals from the phase set point input, cam phase input, first solenoid drive input, and second solenoid drive input and outputting to the first and second solenoid drive outputs such that when a phase set point signal is applied at the phase set point input, the control circuit provides an electrical signal at the first and second solenoid drive outputs to modulate the amount of oil being ported through the control ports and move the spool to control the variable cam phaser to shift the phase of the camshaft as selected by the phase set point signal.

14. The variable cam timing system of claim 12, further comprising a position sensor (34) coupled to the spool, having a position signal output representing the physical position of the spool.

15. The variable timing system of claim 14, further comprising:

i) a VCT control circuit comprising:
- a cam phase input coupled to the VCT phase measurement sensors;
- a phase set point input for accepting a signal representing a desired relative phase of the camshaft and crankshaft;
- a spool valve position input coupled to the position signal output;
- a first solenoid drive output coupled to the electrical input of the first solenoid valve; and
- a second solenoid drive output coupled to the electrical input of the second solenoid valve;
- a signal processing circuit accepting signals from the phase set point input, cam phase input, and spool valve position input and outputting to the first and second solenoid drive outputs such that when a phase set point signal is applied at the phase set point input, the control circuit provides an electrical signal at the first and second solenoid drive outputs to modulate the amount of oil being ported through the control ports and move the spool to control the variable cam phaser to shift the phase of the camshaft as selected by the phase set point signal.

16. The variable cam timing system of claim 15, in which the signal processing circuit comprises:

an outer loop for controlling the phase angle, coupled to the set point input, cam phase input, and first and second solenoid drive outputs; and an inner loop for controlling the spool valve position, coupled to the spool valve position input and to the inner loop;

such that the first and second solenoid drive outputs as set by the outer loop are modified by the inner loop based on the spool valve position.

17. The variable cam timing system of claim 16, in which:

a) the outer loop comprises:
- i) an anti-windup loop comprising:
  - A) a first PI controller (52) having a first input coupled to the set point input; a second input coupled to the cam phase input; a third input and an output;
  - B) a phase compensator (53) having an input coupled to the output of the first PI controller and a first output and a second output; and
  - C) anti-windup logic (54) having an input coupled to the second output of the phase compensator and an output coupled to the third input of the PI controller;
- ii) a combiner (71) having a first input coupled to a null position offset signal (65), a second input coupled to the output of the phase comparator, a third input, and an output; and
- iii) a second PI controller (66) having an input coupled to the output of the combiner and an output coupled to the first and second solenoid drive inputs; and b) the inner loop comprises coupling the spool valve position input to the third input of the combiner.

18. The variable cam timing system of claim 14, wherein the position sensor is selected from the group consisting of a linear potentiometer, a hall effect sensor, and a tape end sensor.

19. The variable cam timing system of claim 14, wherein the spool and the position sensor are coupled by a means selected from the group consisting of a physical coupling, an optical coupling, a magnetic coupling, and a capacitive coupling.

20. The variable cam timing system of claim 12, wherein the oil from the control ports is fed through a center of the camshaft.

21. An internal combustion engine, comprising:

a) a crankshaft;

b) at least one camshaft (33);

c) a cam drive connected to the crankshaft;

d) a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser; and e) a variable cam timing system comprising:

i) a spool valve (28) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser; and ii) a four-way valve (2) comprising:

A) an electrical input, which controls a flow of pressure to the spool;

B) a fluid pressure input;

C) a first control port (3) coupled to a first end (26) of the spool;

D) a second control port (4), coupled to a second end (27) of the spool; and E) at least one exhaust port;

wherein when the four-way valve is in a first position, the pressure input is connected to the first control port, and the exhaust port is connected to the second control port such that oil pressure is transferred to the first end of the spool;

wherein when the four-way valve is in a second position, the pressure input is connected to the second control port, and the exhaust port is connected to the first control port such that oil pressure is transferred to the second end of the spool; and wherein a position of the four-way valve causes the spool to move axially in the bore.

22. The engine of claim 21, further comprising a position sensor (34) coupled to the spool, having a position signal output representing the physical position of the spool.

23. An internal combustion engine, comprising:

a) a crankshaft;

b) at least one camshaft (33);

c) a cam drive connected to the crankshaft;

d) a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser; and e) a variable cam timing system comprising:

i) a spool valve (28) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser;

ii) a first solenoid valve (12) comprising:

A) an electrical input, which controls a flow of pressure to a first end (26) of the spool;

B) a fluid pressure input; and

C) a control port (16) coupled to a first end (26) of the spool, wherein when the solenoid valve is actuated, the control port feeds engine oil pressure (32) to the first end of the spool; and iii) a second solenoid valve (13) comprising:

A) an electrical input, which controls a flow of pressure to the second end (27) of the spool;

B) a fluid pressure input; and

C) a control port (17) coupled to a second end (27) of the spool, wherein when the second solenoid valve is actuated, the control port feeds engine oil pressure (32) to the second end of the spool.

24. The engine of claim 23, further comprising a position sensor (34) coupled to the spool, having a position signal output representing the physical position of the spool.

25. In an internal combustion engine having a variable camshaft timing system for varying the phase angle of a camshaft relative to a crankshaft, a method of regulating the flow of fluid from a source to a means for transmitting rotary movement from the crankshaft to a housing, comprising the steps of:

sensing the positions of the camshaft and the crankshaft;

calculating a relative phase angle between the camshaft and the crankshaft, the calculating step using an engine control unit for processing information obtained from the sensing step, the engine control unit further adjusting a command signal based on a phase angle error;

controlling a position of a vented spool slidably positioned within a spool valve body, the controlling step utilizing a four-way valve comprising an electrical input, which controls a flow of pressure to the spool, a fluid pressure input, a first control port coupled to a first end of the spool, a second control port, coupled to a second end of the spool, and at least one exhaust port, wherein when the four-way valve is in a first position, the pressure input is connected to the first control port, and the exhaust port is connected to the second control port such that oil pressure is transferred to the first end of the spool, wherein when the four-way valve is in a second position, the pressure input is connected to the second control port, and the exhaust port is connected to the first control port such that oil pressure is transferred to the second end of the spool, and wherein a position of the four-way valve causes the spool to move axially in the bore;

supplying fluid from the source through the spool valve to a means for transmitting rotary movement to the camshaft, the spool valve selectively allowing and blocking flow of fluid through an inlet line and through return lines; and transmitting rotary movement to the camshaft in such a manner as to vary the phase angle of the camshaft with respect to the crankshaft, the rotary movement being transmitted through a housing, the housing being mounted on the camshaft, the housing further being rotatable with the camshaft and being oscillatable with respect to the camshaft.

26. The method of claim 25, wherein the step of controlling the position of the vented spool further utilizes a position sensor coupled to the spool, wherein the position sensor senses a position of the spool.

27. The method of claim 26, wherein the position sensor is selected from the group consisting of a linear potentiometer, a hall effect sensor, and a tape end sensor.

28. In an internal combustion engine having a variable camshaft timing system for varying the phase angle of a camshaft relative to a crankshaft, a method of regulating the flow of fluid from a source to a means for transmitting rotary movement from the crankshaft to a housing, comprising the steps of:

sensing the positions of the camshaft and the crankshaft;

calculating a relative phase angle between the camshaft and the crankshaft, the calculating step using an engine control unit for processing information obtained from the sensing step, the engine control unit further adjusting a command signal based on a phase angle error;

controlling a position of a vented spool slidably positioned within a spool valve body, the controlling step utilizing a.a first solenoid valve comprising an electrical input, which controls a flow of pressure to a first end of the spool, a fluid pressure input, and a control port coupled to a first end of the spool, wherein when the solenoid valve is actuated, the control port feeds engine oil pressure to the first end of the spool, and a second solenoid valve comprising an electrical input, which controls a flow of pressure to the second end of the spool, a fluid pressure input, and a control port coupled to a second end of the spool, wherein when the second solenoid valve is actuated, the control port feeds engine oil pressure to the second end of the spool;

supplying fluid from the source through the spool valve to a means for transmitting rotary movement to the camshaft, the spool valve selectively allowing and blocking flow of fluid through an inlet line and through return lines; and transmitting rotary movement to the camshaft in such a manner as to vary the phase angle of the camshaft with respect to the crankshaft, the rotary movement being transmitted through a housing, the housing being mounted on the camshaft, the housing further being rotatable with the camshaft and being oscillatable with respect to the camshaft.

29. The method of claim 28, wherein the step of controlling the position of the vented spool further utilizes a position sensor coupled to the spool, wherein the position sensor senses a position of the spool.

30. The method of claim 29, wherein the position sensor is selected from the group consisting of a linear potentiometer, a hall effect sensor, and a tape end sensor.

* * * * *

UNITED STATES PATENT AND TRADEMARK OFFICE

CERTIFICATE OF CORRECTION

PATENT NO. : 6,622,675 B1
DATED : September 23, 2003
INVENTOR(S) : Roger Simpson It is certified that error appears in the above-identified patent and that said Letters Patent is hereby corrected as shown below:

Title page, Item [54] and Column 1, lines 1-3,
Title, should read:
-- DUAL PWM CONTROL OF A CENTER MOUNTED SPOOL VALVE TO CONTROL A CAM PHASER --

Signed and Sealed this

Twenty-seventh Day of January, 2004

JON W. DUDAS
*Acting Director of the United States Patent and Trademark Office*